US006796149B2

(12) United States Patent
Okamoto et al.

(10) Patent No.: US 6,796,149 B2
(45) Date of Patent: Sep. 28, 2004

(54) METHOD OF KNITTING FABRIC

(75) Inventors: Kazuyoshi Okamoto, Wakayama (JP); Yukihide Maeda, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/467,922

(22) PCT Filed: Feb. 18, 2002

(86) PCT No.: PCT/JP02/01406

§ 371 (c)(1),
(2), (4) Date: Aug. 14, 2003

(87) PCT Pub. No.: WO02/066722

PCT Pub. Date: Aug. 29, 2002

(65) Prior Publication Data

US 2004/0083766 A1 May 6, 2004

(51) Int. Cl.[7] ..... D04B 7/04
(52) U.S. Cl. ..... 66/64; 66/176
(58) Field of Search ..... 66/64, 69, 176, 66/68–70, 169 R–171, 189

(56) References Cited

U.S. PATENT DOCUMENTS 5,417,088 A 5/1995 Nakai
6,550,284 B2 * 4/2003 Okamoto ..... 66/69
6,658,899 B2 * 12/2003 Okamoto ..... 66/69
6,668,593 B2 * 12/2003 Okamoto ..... 66/69

FOREIGN PATENT DOCUMENTS

| | | | |
|---|---|---|---|
| JP | 3010484 | B2 | 2/2000 |
| JP | 2000-303327 | A | 10/2000 |
| WO | WO 00/12799 | A1 | 3/2000 |
| WO | WO 01/063030 | A1 | 8/2001 |

* cited by examiner

*Primary Examiner*—Danny Worrell
(74) *Attorney, Agent, or Firm*—Rothwell, Figg, Ernst & Manbeck, P.C.

(57) ABSTRACT

In a process of knitting a fabric during which at least a part of loops in the flechage knitting region are transferred between the front and back needle beds to move the loops laterally, loops in a stitch move region which are moved laterally whenever an adequate number of courses of the flechage knitting region are knitted are transferred to an opposite needle bed and then the front and back needle beds are moved relative to each other. Then, loops of wale which are put in the rest state in a process of the flechage knitting are held on the needle bed opposite to the needle bed on which loops of a next course are formed in a sequent flechage knitting until the stitch move is completed. Only the loops of the wale in which the loops of the next course are formed in the sequent knitting are transferred back to their originally retained needle bed prior to the forming of the loops of the next course. This knitting is repeatedly performed. This can allow the knitting of the region where the flechage knitting and the stitch move are performed concurrently without incurring problems such as stitch drop, yarn breakage, and the like.

5 Claims, 8 Drawing Sheets

6-a 6-c 6-b

METHOD OF KNITTING FABRIC

TECHNICAL FIELD

The present invention relates to a method of knitting fabric with a flat knitting machine and, more particularly, to a method of knitting fabric in which at least a part of loops in a flechage knitting region where yarn is caused to reverse in yarn feed direction at some midpoints of knitting width for knitting the region are transferred between front and back needle beds, for stitch move.

BACKGROUND ART

A variety of knitting methods have been proposed for knitting a fabric which is called integral garment, according to which when a front body of a vest or a sweater is knitted with a flat knitting machine, a neckline opening can be formed on the flat knitting machine to relieve a sewing operation after completion of the knitting. The applicant of this application previously disclosed in Japanese Patent No. 2538421 an integral garment knitting method in which the number of wales around an edge portion of a neckline opening of a vest or sweater is increased to increase a peripheral length of the neckline opening. The way of increasing the peripheral length of the neckline opening of the vest 101 as disclosed in Japanese Patent No. 2538421 will be described with reference to FIGS. 7 and 8. According to the knitting method disclosed in Japanese Patent No. 2538421, a front body 101 of the vest is knitted starting at a hem 102 toward a neckline opening 103 and then is forked into a right front body 101*a* and a left front body 101*b*. Starting with the neckline opening 103, the right front body 101*a* and the left front body 101*b* are each knitted in the flechage knitting. From a line V in FIG. 7, the right front body 101*a* and the left front body 101*b* are each moved outwards, to form empty needles between the neckline opening 103 and the right and left front bodies 101*a*, 101*b* and then new loops are formed on the empty needles thus formed, to increase the number of wales around an edge portion 104 of the neckline opening 103, so as to increase a peripheral length of the neckline opening 103. Then, a collar 105 is formed around the edge portion 104 of the neckline opening 103 thus increased in number of wale, so that the collar 105 having a large diameter is formed. The knitting mentioned above can make a vest of a high commercial value having the neckline opening that can allow one's head to smoothly pass through when wearing.

The knitting for increasing the peripheral length of the neckline opening of the front body 101 of the vest is described with reference to the knitting course diagram of FIG. 8. In the following, only the knitting for the left front body 101*b* will be described, because the same knitting is symmetrically performed for the right and left front bodies 101*a*, 1101*b*. The course 1 of FIG. 8 shows a right side of the vest 101 knitted up to the line V of FIG. 7. The needles A–D of the front needle bed are used for the neckline opening 103 and the needles E–K of the front needle bed are used for the left front body 101*b*. In the course 2, the loops of the left front body 101*b* retained on the needles E–K of the front needle bed are transferred to the back needle bed. In the course 3, after the back needle bed is racked rightward one pitch, the loops of the left front body 101*b* are transferred to the front needle bed, to make the needle E of the front needle bed an empty needle. In the next course 4, a yarn is fed to the needle E of the front needle bed to form a new loop thereat and also fed to the needles F–L of the front needle bed. In the course 5, the yarn is fed to the needles L–F of the front needle bed to knit the left front body 101*b*. In the course 6, the loops on the needles F–L of the front needle bed are transferred to the back needle bed. In the course 7, after the back needle bed is further racked rightward one pitch, the left front body 101*b* is transferred back to the front needle bed. In the course 8, a new loop is formed on the needle F of the front needle bed and the yarn is fed to the needles G–M of the front needle bed. In the course 9, the yarn is fed to the needles M–G of the front needle bed to knit the left front body 101*b*. Subsequently, by repeating the same knitting as the knitting of the courses 6–9, new wale around the edge portion 104 of the neckline opening 103 is added on the needles E–G of the front needle bed to produce the state of the course 10. Thereafter, in the course 11, the yarn is fed to the needles N–A of the front needle bed. After this manner, the knitting of increasing the number of wales around the edge portion 104 of the neckline opening is completed. Subsequently, the same knitting is performed for the right front body 101*a*. Thereafter, the collar 105 is formed, with which the front body 101 is completed.

In addition to the knitting mentioned above, the flechage knitting is repeatedly performed to gradually narrow the knitting widths of the right and left front bodies, whereby shoulder drops 9*a*, 9*b* like those formed in the vest of FIG. 1 are formed. However, according to the method disclosed by Japanese Patent No. 2538421, whenever the right and left front bodies 101*a*, 101*b* are moved outwards, as shown in the courses 3 and 7 of FIG. 8, all loops of the right and left front bodies 101*a*, 101*b* are transferred back to the front needle bed before the new loops are formed. Due to this, whenever the number of wales around the edge portion 104 of the neckline opening 103 is increased, the right and left front bodies 101*a*, 101*b* must be transferred between the front and back needle beds repeatedly. Accordingly, when the right and left front bodies 101*a*, 101*b* are knitted in the flechage knitting to form the shoulder drops 9*a*, 9*b*, the loops which are in the rest state must be transferred between the front and back needle beds repeatedly, due to which the increase of the number of wales around the edge portion 104 of the neckline opening 103 may cause problems of yarn breakage, elongation of loop, and the like. Thus, since the method disclosed by Japanese Patent No. 2538421 involves the problem that yarn breakage and like problems may be caused by the repeated loop transfer when the shoulder drops are formed, it has the disadvantage that the number of wales around the edge portion of the neckline opening cannot be increased to a satisfactory extent.

DISCLOSURE OF THE INVENTION

In order to solve the problems mentioned above, the present invention provides a method of knitting a fabric by using a flat knitting machine comprising at least a pair of front and back needle beds, at least either of which can be racked laterally, wherein a flechage knitting region is formed by a flechage knitting wherein a yarn feeder is caused to reverse in yarn feed direction at some midpoints of knitting width to put needle in a rest state sequentially from the needle positioned at an end of knitting width and a stitch move is performed in such a manner that at least a part of loops in the flechage knitting region are transferred between the front and back needle beds to move the loops laterally, and wherein after loops in a stitch move region which are moved laterally whenever an adequate number of courses of the flechage knitting region are knitted are transferred to an opposite needle bed, the front and back needle beds are moved relative to each other and, then, loops of wale which are put in the rest state in a process of the flechage knitting are held on the needle bed opposite to the needle bed on which loops of a next course are formed in a sequent flechage knitting until the stitch move is completed, and only the loops of the wale in which the loops of the next course are formed in the sequent knitting are transferred back to their originally retained needle bed prior to the forming of the loops of the next course, the knitting being repeatedly performed.

According to the construction of the present invention mentioned above, when a knitted fabric is knitted to include the flechage knitting region by a flechage knitting wherein needles are put in the rest state sequentially from the needle positioned at an end of knitting width and by the stitch move wherein at least a part of loops in the flechage knitting region are transferred between the front and back needle beds to move the loops laterally, the loops in the stitch move region are transferred to the needle bed opposite to the needle bed on which the loops in the stitch move region are knitted in the flechage knitting. Then, when the loops in the stitch move region are transferred back to their originally retained needle bed from the opposite needle bed, for the sequent flechage knitting, only the loops in wale in which the loops of the next course are formed are transferred back to the front needle bed in the state in which the loops that were put in the rest state in the process of the flechage knitting are retained on the opposite needle bed, to form the loops of the next course. This knitting is repeatedly performed until the stitch move of all the loops is completed. Accordingly, there is no need for the loops that were put in the rest state in the process of the flechage knitting to be transferred between the front and back needle beds repeatedly. Hence, possible problems such as yarn breakage and elongation of loop can be avoided.

The present invention provides a method of knitting a fabric by using a flat knitting machine comprising at least a pair of front and back needle beds, at least either of which can be racked laterally, wherein in a process of knitting a body from its hem to its neckline, after start of forming of a neckline opening, right and left bodies confronting each other across the neckline opening are knitted with different yarn feeders in a flechage knitting; while loops of the right and left bodies are put into the rest state sequentially from wale on a shoulder-point side, the right and left bodies are transferred between the front and back needle beds, so that they are moved outwards to provide empty needles between the neckline opening and the right and left front bodies; that new loops are formed on the empty needles thus formed, to increase the number of wales around an edge portion of the neckline opening; and then, a collar is formed around the neckline opening, and wherein the knitting includes a stitch move which is carried out while the right and left bodies are knitted in the flechage knitting, the knitting comprising the following steps:

(1) that either of the right and left bodies is knitted in the flechage knitting in an adequate number of courses;

(2) that the one body knitted in the flechage knitting in the step (1) is retained on the opposite needle bed and the front and back needle beds are moved relative to each other in a direction in which the neckline opening is expanded;

(3) that only the loops of the wale which are sequentially knitted in a sequent flechage knitting, of the one body retained on the opposite needle bed in the step (2), are transferred back to their originally retained needle bed; and (4) that the steps (1) to (3) are repeatedly performed until the knitting of the one body is completed.

According to the construction of the present invention mentioned above, in a process of knitting a body from its hem to its neckline, after start of forming of a neckline opening, right and left bodies confronting each other across the neckline opening are knitted with different yarn feeders in a flechage knitting. Then, while loops of the right and left bodies are put into the rest state sequentially from wale on a shoulder-point side in the process of the flechage knitting, the right and left bodies are transferred between the front and back needle beds, so that they are moved outwards to provide empty needles between the neckline opening and the right and left front bodies. In parallel with the knitting for increasing the number of wale of the edge portion around the neckline opening, the right and left bodies are knitted in the flechage knitting, in order to form shoulder drops. When the right and left bodies are moved outwards in the knitting process of moving the right and left bodies outwards and also forming the shoulder drops, their loops are transferred to the needle bed opposite to the needle bed on which the loops are formed and then the front and back needle beds are moved relative to each other in a direction in which the body moves away from the neckline opening. Then, when the loops of the right and left bodies are transferred back to their originally retained needle bed, for forming the loops in the sequent knitting, only the loops of the wale in which loops of a next course are formed are transferred back to their originally retained needle bed, while the loops that were put in the rest state in the process of the flechage knitting are left on the opposite needle bed. These knitting steps are repeatedly performed. This can eliminate the need for the loops that were put in the rest state in the flechage knitting for forming the shoulder drops to be transferred between the front and back needle beds repeatedly. Hence, possible problems such as yarn breakage and elongation of loop can be avoided. Accordingly, the right and left bodies can be moved outwards as far as desired. This enables the number of wales of the edge portion around the neckline opening to be increased freely even when the shoulder drops are formed.

Also, the present invention provides a method of knitting a fabric having a body, a right sleeve and a left sleeve by using a flat knitting machine comprising at least a pair of front and back needle beds, at least either of which can be racked laterally, wherein the right and left sleeves are knitted on both sides of the body; parts of the right and left sleeves extending from underarms to shoulder are shifted toward the body, so that the loops of the right and left sleeves and the loops of the body at ends thereof on the side adjacent to each other are overlapped with each other; and then loops of a next course are formed in the double loops thus formed, this knitting being repeatedly performed to knit a knitwear having the sleeves and the body joined to each other, in the process of which flechage knitting regions where the sleeves and the body are joined together while in a flechage knitting connecting together an adequate number of wales of the sleeve and the body positioned around the boundary therebetween are formed in joining regions between the body and the right and left sleeves and, then, the sleeves and the body are each narrowed while the yarn is fed to the sleeves and the body, to form a parachute pattern, wherein the knitting for forming the flechage knitting regions comprises the following steps:

(1) that the flechage knitting is performed connecting together an adequate number of wales of both of the body and one of the sleeves around the boundary therebetween in either of the right and left flechage knitting regions;

(2) that the sleeve that was knitted in the flechage knitting in the step (1) is retained on the needle bed opposite to the needle bed on which the body is retained and the front and back needle beds are moved relative to each other in a direction in which the sleeve moves closer to the body;

(3) that only the loops of the wale of the sleeve retained on the opposite needle bed in the step (2) in which loops of a next course are sequentially formed in a sequent knitting are transferred back to the needle bed on which the body is retained, to overlap the loops of the sleeve with the loops of the body at ends thereof on the side adjacent to each other, so as to join together the sleeve and the body; and (4) that the steps (1) to (3) are repeatedly performed until the flechage knitting regions formed around the boundary between the one sleeve and the body are completed.

According to the construction of the present invention mentioned above, the right and left sleeves are knitted on both sides of the body and are shifted toward the body, so that the loops of the right and left sleeves and the loops of the body at ends thereof on the side adjacent to each other are overlapped with each other from underarms to shoulder, to form the double loops and then loops of a next course are formed in the double loops thus formed. This knitting is repeatedly performed to knit a knitwear having the sleeves and the body joined to each other. In this knitting process, flechage knitting regions where the sleeves and the body are joined together while flechage knitting is performed connecting together an adequate number of wales of the sleeve and the body positioned around the boundary therebetween are formed in joining regions between the body and the right and left sleeves. When the sleeves are shifted to the body and jointed thereto while the flechage knitting region is formed, the loops of the sleeves in the flechage knitting region are transferred to the opposite needle bed and then the front and back needle beds are moved relative to each other so that the sleeve can be moved away from the body. Then, when the sleeves are transferred back to their originally retained needle bed on which the body is retained, only the loops of the wale in which loops of a next course are sequentially formed in a sequent flechage knitting are transferred back to the needle bed on which the body is retained, while the loops of the wale that were put in the rest state in the process of the flechage knitting are left on the needle bed opposite to the needle bed on which the body is retained. Thus, the sleeves can be shifted to and joined to the body without the need for the loops that were put in the rest state in the process of knitting the flechage knitting region to be transferred between the front and back needle beds repeatedly. Also, when the parachute pattern is formed after the flechage knitting region is knitted, diameter of the parachute pattern can be kept uniform. Therefore, the knitted fabric is prevented from being strained or loosened at the parachute pattern. Also, even when a color pattern is formed in the parachute pattern, the color pattern can be prevented from being transformed.

BEST MODE FOR CARRYING OUT THE INVENTION

In the following, a method of knitting fabric of the present invention will be described with reference to the accompanying drawings. Illustrated below are embodiments using a two-bed flat knitting machine comprising a pair of front and back needle beds, either or both of which is slidable laterally so that loop transfer can be performed between knitting needles fitted in needle grooves formed on the front and back needle beds.

First Embodiment

Figure 1:
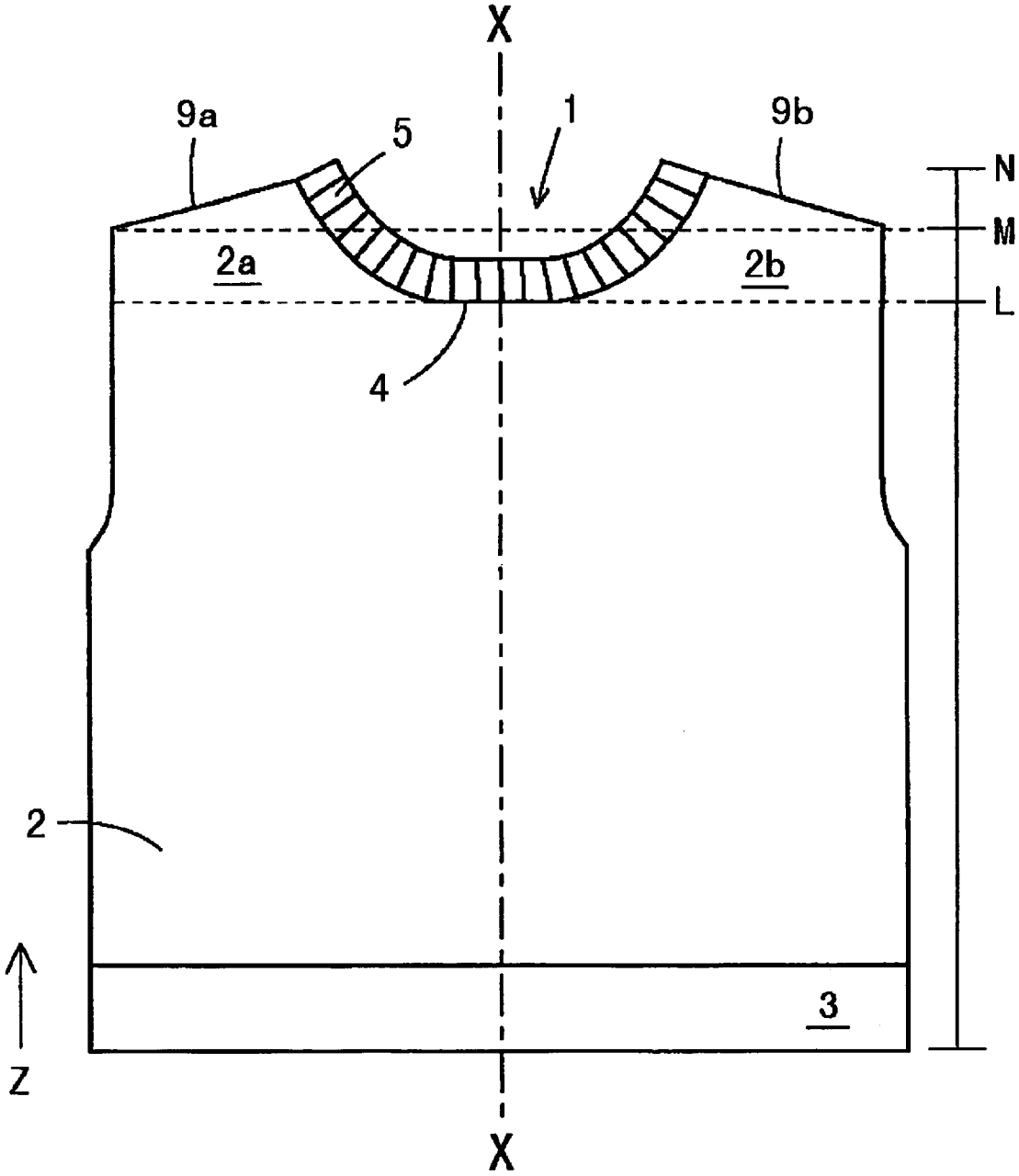
FIG. 1 is a view showing a front body of a vest formed in the first embodiment.
Figure 2:
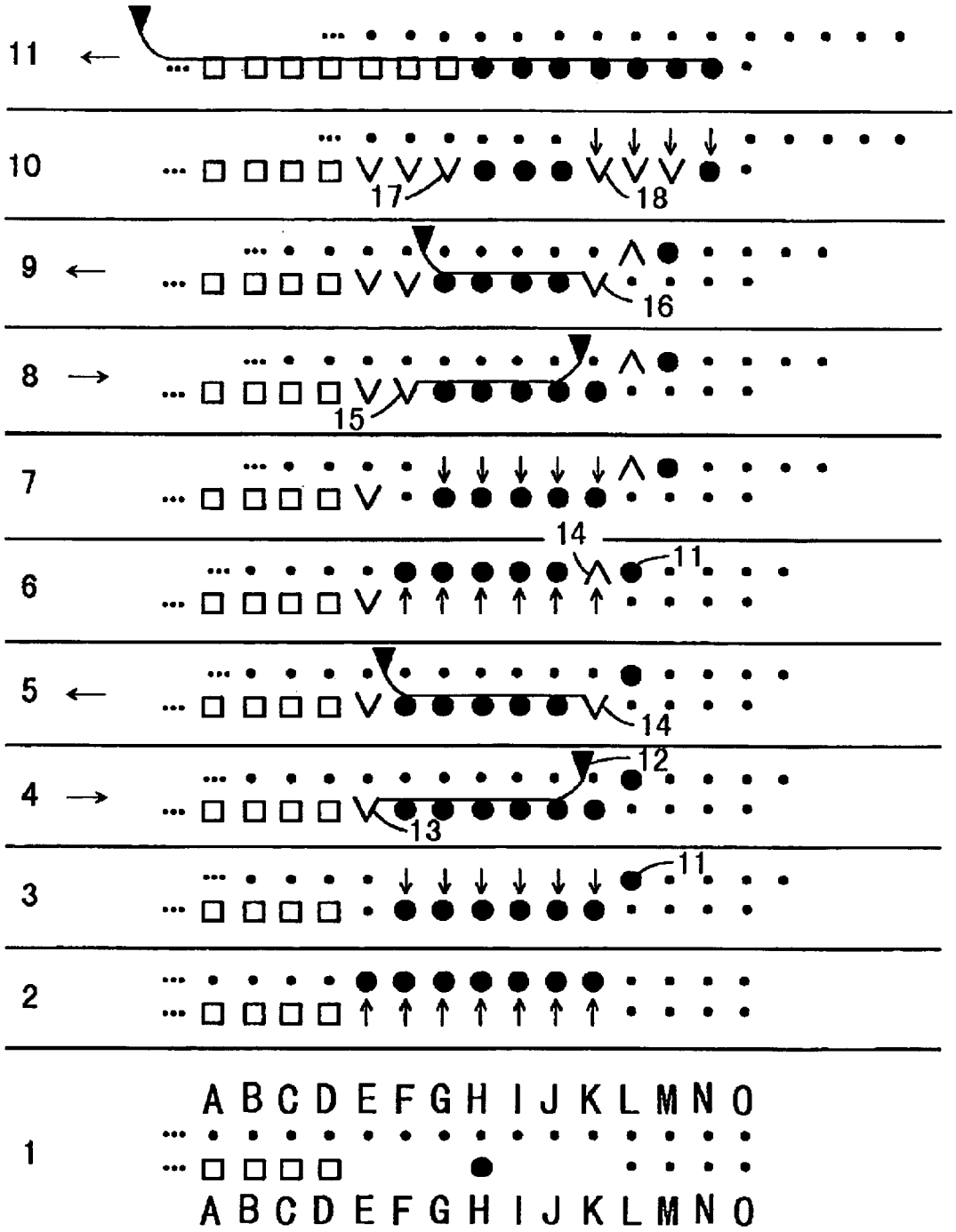
FIG. 2 is a knitting course diagram showing the first embodiment.

The first embodiment of the present invention is described, taking a method of knitting a front body 2 of a vest of FIG. 1 having an increased number of wales around an edge portion of a neckline opening 1 and shoulder drops formed therein. FIG. 1 shows the front body 2 of the vest. FIG. 2 is a knitting course diagram showing the knitting steps starting with the forming of the shoulder drops 9*a*, 9*b*.

A front body 2 of the vest is knitted in the direction indicated by an arrow Z, starting at a hem 3 toward a neckline opening 1, and is forked into a right front body 2*a* on the right side of the neckline opening 1 and a left front body 2*b* on the left side of the neckline opening 1 from a line L from which the form of the neckline opening 1 is started. The right front body 2*a* and the left front body 2*b* are each knitted in the flechage knitting where a yarn feeder is caused to reverse in a traveling direction between an edge portion 4 around the neckline opening 1 and each side end of the body 2. In an upper portion of the neckline opening between lines M and N, the flechage knitting wherein loops are put into the state of being rested from the knitting in the order from the wale on the shoulder-point side is performed to gradually narrow the knitting width. Also, a stitch move is performed to move the right front body 2*a* and the left front body 2*b* outwards to make the needles positioned between the neckline opening 1 and the right and left front bodies 2*a*, 2*b* empty needles. Then, new loops are formed on the empty needles thus formed, to increase the number of wales around the edge portion 4 of the neckline opening 1. By combination of this knitting with the flechage knitting, the right front body 2*a* and the left front body 2*b* are knitted. This knitting is repeatedly performed to increase the number of wales around the edge portion 4 of the neckline opening. Thereafter, a collar 5 is formed around the edge portion 4 of the neckline opening 1. As a result of this, the front body 2 having an increased number of wales around the edge portion 4 of the neckline opening 1 and having the shoulder drops 9*a*, 9*b* is knitted.

In the following, reference is made to the knitting courses with reference to FIG. 2. For convenience of explanation, a fewer number of needles than the actual number of needles used for the actual knitting of this embodiment is illustrated. Also, since the way of forming the neckline opening 1 in the flechage knitting is already known, the description on the knitting courses starts with a starting point of the knitting for increasing the number of wales around the edge portion 4 of the neckline opening 1.

The same knitting is symmetrically performed for the right and left front bodies 2*a*, 2*b*. After one front body portion (e.g. the right front body 2*a*) is knitted to the end, another front body portion (e.g. the left front body 2*b*) is knitted. In the course 1 of FIG. 2, loops that come to form the edge portion 4 of the neckline opening 1 are retained on the needles A–D of the front needle bed and loops of the left front body 2*b* are retained on the needles E–K of the front needle bed. The loops of the edge portion 4 of the neckline opening 1 are put in the rest state while the right and left front bodies 2*a*, 2*b* are knitted in the flechage knitting. In the course 2, the loops of the left front body 2*b* are transferred to the opposite back needle bed. In the course 3, after the back needle bed is racked rightwards one pitch, a wale of loops of the left front body 2*b*, except a loop 11 at an end thereof where no loop of the next course is formed in the sequent flechage knitting, are transferred back to the front needle bed, to make the needle E of the front needle bed an empty needle. In the course 4, a yarn is fed to the needle E of the front needle bed through a yarn feeder 12 to form a new loop 13 at the edge portion 4 around the neckline opening 1 and also is fed to the needles F–J of the front needle bed to knit the left front body 2*b*. In the course 5, after the yarn feeder 12 is reversed, a tuck loop 14 is formed by the needle K in order to prevent a knitted fabric from being holed at the reverse point and also the yarn is fed to the needles J–F of the front needle bed. In the course 6, the loops of the left front body 2*b* retained on the front needle bed are all transferred to the back needle bed. In the course 7, after the back needle bed is racked rightwards further one pitch, a wale of loops of the left front body 2*b*, except the loops 11, 14 on the needles M and J where no loop of the next course is formed in the sequent flechage knitting, are transferred to the front needle bed, to make the needle F of the front needle bed an empty needle. In the course 8, after a new loop 15 is formed on the needle F of the front needle bed, the yarn is fed to the needles G–J of the front needle bed. In the course 9, after the yarn feeder 12 is reversed, a tuck loop 16 is formed by the needle K of the front needle bed and also the yarn is fed to the needles J–G of the front needle bed. Subsequently, the same knitting as the knitting shown in the courses 6 to 9 is repeatedly performed with the target needles changed. Thereafter, in the course 10, the loops 11, 14, 18 which are in the held state on the back needle bed are transferred back to the front needle bed. Then, in the course 11, the yarn is fed to the needles N–A of the front needle bed. In the knitting steps mentioned above, the knitting of the left front body 2*b* is ended.

The knitting mentioned above produces the shoulder drop 9*b* in the right front body 2*b* and also provides an increased number of wales around the edge portion 4 of the neckline opening 1 by three wale from the state of the course 1. Thereafter, the same knitting is performed for the right front body 2*a* as well. Then, the collar 5 is formed along the edge portion 4 around the neckline opening 1. As a result of this, the front body 2 is completed.

As mentioned above, in this embodiment, in parallel with the flechage knitting of the left front body 2*b*, the stitch move for allowing the left front body 2*b* to move outwards is performed so that the needles positioned between the edge portion 4 of the neckline opening 1 and the left front body 2*b* are made the empty needles and then the new loops 13, 15, 17 are formed on those empty needles. This provides an increased number of wales around the edge portion of the neckline opening 1. Also, when the left front body 2*b* after moved outwards is transferred back to the front needle bed, for the flechage knitting, the loops 11, 14, 18 of the left front body 2*b* which were put in the rest state in the process of the flechage knitting are kept on the back needle bed and only a wale of loops in which the loops of the next course are formed in the sequent knitting are transferred back to the front needle bed. Accordingly, there is no need for the loops 11, 14, 18 that were put in the rest state to be transferred between the front and back needle beds repeatedly. Although the number of wales is increased as many as only three in the embodiment mentioned above, for convenience sake, the number of wales around the edge portion 4 of the neckline opening 1 can be practically increased freely, without anxiety about possible yarn breakage or like problems.

Second Embodiment

Figure 3:
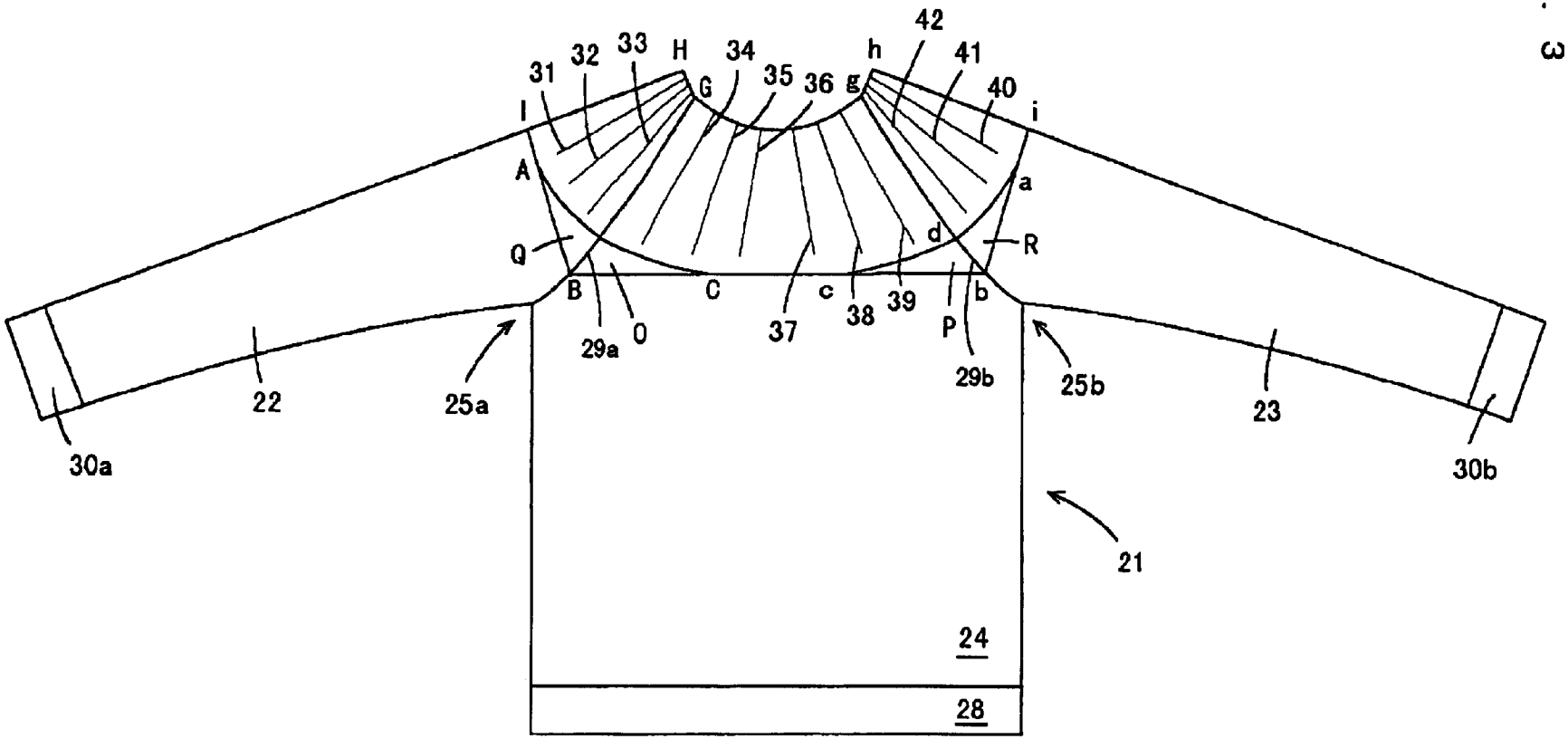
FIG. 3 is a view showing a sweater fabric formed in the second embodiment.

The second embodiment of the present invention is described with reference to FIGS. 3–5. The second embodiment is an embodiment of a method of knitting a sweater having a pattern commonly known as a parachute pattern in which joining lines along which adjacent loops are overlapped with each other radiate outward from around the neckline opening in a sweater fabric 21 that becomes a front part of the sweater of FIG. 3 in a region in the vicinity of the shoulder and above the underarms. In the second embodiment, a body and right and left sleeves of the sweater 21 which are knitted in different regions are joined together starting at sides thereof Prior to the forming of the parachute pattern, flechage knitting regions O, P, Q, R extending on each side of a joining line between the sleeve 22, 23 and the body 24 are knitted in the flechage knitting. Thereafter, the parachute pattern is formed to radiate outwards with a uniform radius.

Figure 4:
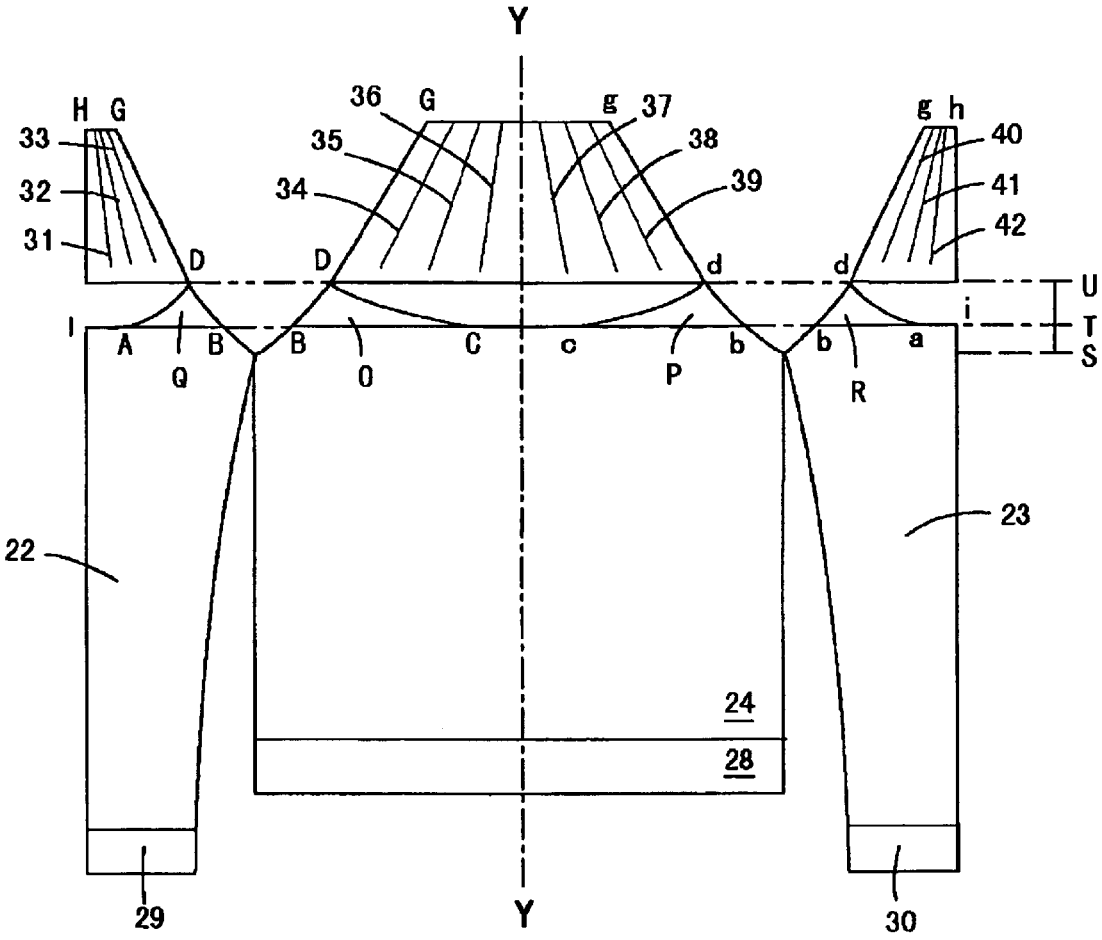
FIG. 4 is a view showing the sweater fabric which is in the state to be knitted on a flat knitting machine in the second embodiment.

FIG. 4 is a view showing the sweater fabric 21 which is in the state to be knitted on a flat knitting machine. The sweater fabric 21 is composed of a front body 24, a right sleeve 22 and a left sleeve 23 which are joined together along joining lines 29*a*, 29*b* extending from the underarms 25*a*, 25*b* to the shoulder. The front body 24 is knitted from a hem 28 to the shoulder in the direction indicated by an arrow Z and the right and left sleeves 22, 23 are knitted from lower sleeve edges 30*a*, 30*b* toward the shoulder in the direction indicated by the arrow Z. After the front body 24 and the right and left sleeves 22, 23 are knitted up to a line S at which the joining of the front body 24 and the right and left sleeves starts, the right and left sleeves 22, 23 are each shifted toward the front body 24. The loops of the right and left sleeves 22, 23 and the front body 24 at ends thereof on the side adjacent to each other are overlapped with each other and then the yarn is fed to those loops. This knitting is repeatedly performed to knit the front body 24 and the right and left sleeves 22, 23 in the form of a single knitted fabric via a common yarn feeder. As a result of this, the right and left sleeves 22, 23 are joined to the front body 24, while narrowing is provided.

Sequentially, after the knitted fabric is knitted up to a line T, a right flechage knitting region of the front body 24 and right sleeve 22 surrounded by a line A-B-C-D and a left flechage knitting region of the front body and left sleeve 23 surrounded by a line a-b-c-d are knitted sequentially. In the flechage knitting regions, the loops are put in the rest state sequentially from the wale at right and left ends of the first knitting widths A-B-C and a-b-c, so that the number of knitting courses is maximized at the joining lines 29*a*, 29*b* between the front body 24 and the right and left sleeves 22, 23. From a line U where the flechage knitting is ended, the front body 24 and the right and left sleeves 22, 23 are knitted with the yarn fed along the line I-D-C-c-d-I via the common yarn feeder. Also, the knitting wherein the right and left sleeves 22, 23 are shifted to and joined to the front body 24 at the joining lines and the narrowing knitting wherein the front body 24 and the right and left sleeves 22, 23 are narrowed at locations of narrowing lines 31–42 are performed repeatedly until the final knitting width H-G-g-h is provided.

In the following, the knitting courses are described with reference to FIG. 5. Since the knitting of the front body 24 and the right and left sleeves 22, 23 from the beginning to the line S is known, the knitting of the same from the line T is described. Also, since the same knitting is performed symmetrically at the right side and the left side of the line Y—Y, only the knitting of the joining portion between the front body 24 and the left sleeve 23 is described.

Figure 5:
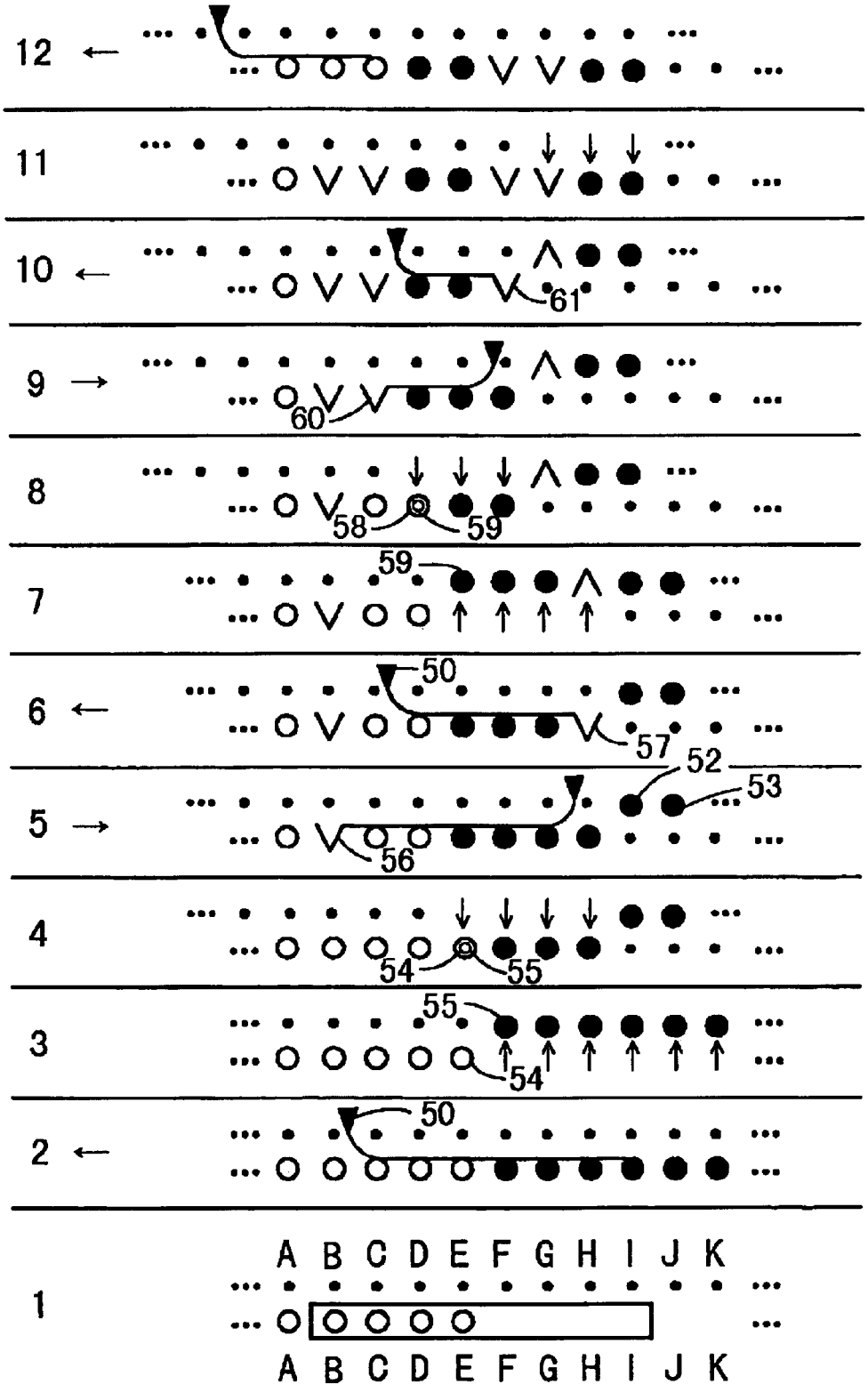
FIG. 5 is a knitting course diagram showing the second embodiment.

In the course 1 of FIG. 5, the loops of the front body 24 are depicted by white circles, and the loops of the left sleeve 23 are depicted by black circles. The loops in the flechage knitting region a-b-c of the front body 24 and left sleeve 23 are framed. The loops between a and b in the flechage knitting region R are retained on the needles I–F of the front needle bed, and the loops between b and c in the flechage knitting region P are retained on the needles E–B. In the course 2, the yarn is fed to the needles I–C of the front needle bed positioned in the boundary between the left front sleeve 23 and the front body 24 via a yarn feeder 50, and the needle B of the front needle bed is put in the rest state. In the course 3, the loops of the left sleeve 23 are transferred to the back needle bed. Then, in the course 4, the back needle bed is racked leftwards one pitch. Thereafter, in the courses 5–6, only the loops on the needles F–I where the loops of the next course are formed are transferred to the front needle bed, and the loops 52, 53 on the needles J, K of the back needle bed where no new loop is formed are held on the back needle bed during the knitting of the flechage knitting regions P, R. Then, the left sleeve 23 and the front body 24 are joined together by overlapping the loop 54 of the front body 24 and the loop 55 of the left sleeve 23 with each other at ends thereof on the side adjacent to each other. In the course 5, a tuck loop 56 is formed on the needle M of the front needle bed via the yarn feeder 50, to prevent a knitted fabric from being holed and also the yarn is fed to the needles C–G of the front needle bed, with the needle H of the front needle bed put in the rest state. In the next course 6, the yarn feeder 50 is reversed and a tuck loop 57 is formed by the needle H of the front needle bed and also the yarn is fed to the needles G–D of the front needle bed, with the needle C of the front needle bed put in the rest state. In the course 7, the loops of the left front body 23 retained on the needles E–H of the front needle bed are transferred to the back needle bed. Then, in the course 8, after the back needle bed is racked leftwards further one pitch, the loops of the front body to which the loops of the next course are formed in the next knitting course are transferred to the front needle bed to overlap the loop6 58 of the front body 24 and the loop 59 of the left sleeve 23 with each other at ends thereof on the side adjacent to each other, so as to join together the left sleeve 23 and the front body 24. In the course 9, a tuck loop 60 is formed by the needle C of the front needle bed that was put in the rest state, in order to prevent the knitted fabric from being holed, and also the yarn is fed to the needles D, E of the front needle bed. In the course 10, a tuck loop 61 is formed by the needle F of the front needle bed to prevent the knitted fabric from being holed, and also the yarn is fed to the needles D, E of the front needle bed. In the course 11, the knitting of the left flechage knitting regions P, R is completed and the loops of the left sleeve 23 retained on the back needle bed are all transferred back to the front needle bed. Then, in the course 12, after the yarn feeder 50 is reversed, the yarn is fed to the front body 24 and the right sleeve 22 from the needle C of the front needle bed. Subsequently, the same knitting as the knitting mentioned above is symmetrically performed for the right flechage knitting regions O, Q. After the knitting of both of the right flechage knitting region and the left flechage region is completed, the yarn is fed to the front body 24 and the right and left sleeves 22, 23 via the common yarn feeder and the right and left sleeves 22, 23 are shifted toward the front body 24 and joined thereto. In parallel with this, the narrowing wherein the loops of the front body 24 and the loops of the right and left sleeves 22, 23 which are positioned outside of the narrowing lines 31–42 are shifted toward the line Y—Y and then the adjacent loops are overlapped with each other is performed to form the parachute pattern around the shoulder.

As mentioned above, in the second embodiment, there is no need for the loops 52, 53, 57 of the sleeve 23, in which no new loop is formed while the flechage knitting region is knitted, to be repeatedly transferred between the front and back needle beds. Hence, possible problems such as yarn breakage and elongation of loop can be avoided. In the conventional knitting method, the parachute portion is formed without any flechage knitting regions O, P, Q, R, so that a required knitted fabric length between H–I and a required knitted fabric length between G–B which are different from each other are formed by the loops of the same number. As a result, the knitted fabric around the joining lines 29*a*, 29*b* requiring a largest knitted fabric length is strained, causing problems such as a spoiled comfy fit or transformation of color pattern of the parachute pattern when designed with colors. In contrast to this, in this embodiment, since the flechage knitting is provided for regions where the loop are insufficient in number for a required knitted fabric length, to compensate for the shortfall before the parachute pattern is formed, the problems, such as a spoiled comfy fit or transformation of color pattern of the parachute pattern, can be avoided.

Although the knitting of joining together the front body 24 and the front sleeves 22, 23 has been described in the embodiment mentioned above, the present invention is applicable to another formation of knitted fabric, such as a knitted fabric comprising front and back bodies which are knitted in an overlapped relation and are joined together at both ends thereof so that they are formed in a tubular form and right and left sleeves which are joined together at both ends thereof so that they are formed in a tubular form. In the case of this tubular fabric, since the direction in which the back needle bed is racked to shift the right front sleeve toward the front body and the direction in which the back needle bed is racked to shift the left back sleeve toward the front body are common to each other, the knitting of the flechage knitting regions between the right front sleeve and the front body and between the left back sleeve and the back body and the joining may be performed concurrently. Likewise, since the direction in which the back needle bed is racked to shift the left front sleeve toward the front body and the direction in which the back needle bed is racked to shift the right back sleeve toward the back body are common to each other, the knitting of the flechage knitting regions between the left front sleeve and the front body and between the right back sleeve and the back body and the joining may be performed concurrently. When the sleeve is shifted toward the body beyond a maximum racking pitch limit of the needle bed in one direction, it is required that one needle bed be racked in the opposite direction (racked back) in the state in which the loops of the sleeve are all retained on the needle bed for a while. This can also reduce the number of times for loop transfer significantly.

Third Embodiment

Figure 6:
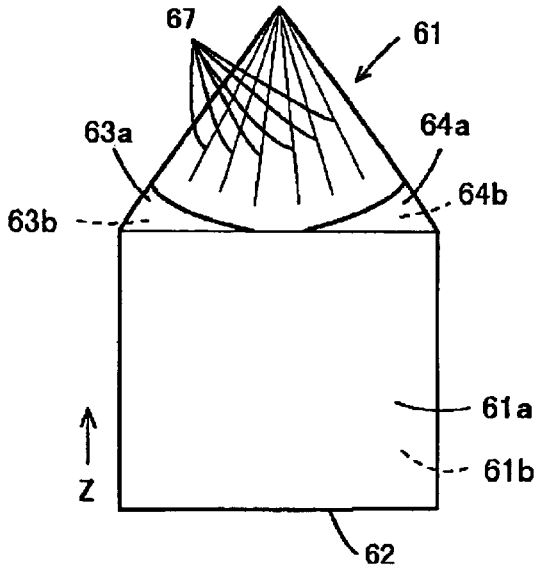
FIG. 6-*a* is a front view of a fabric formed in the third embodiment, FIG. 6-*b* is a plan view thereof, and FIG. 6-*c* is a view showing the fabric which is in the state to be knitted on the flat knitting machine.
Figure 6:
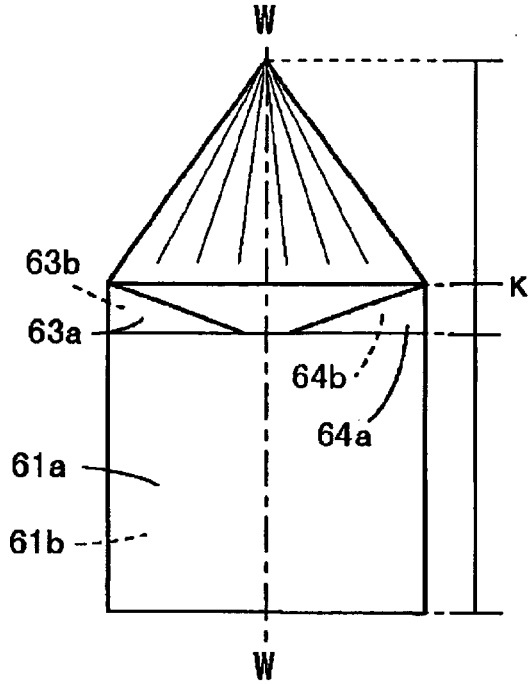
Figure 6:
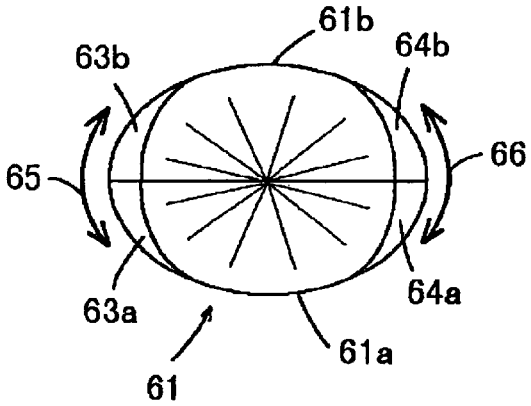
Figure 7:
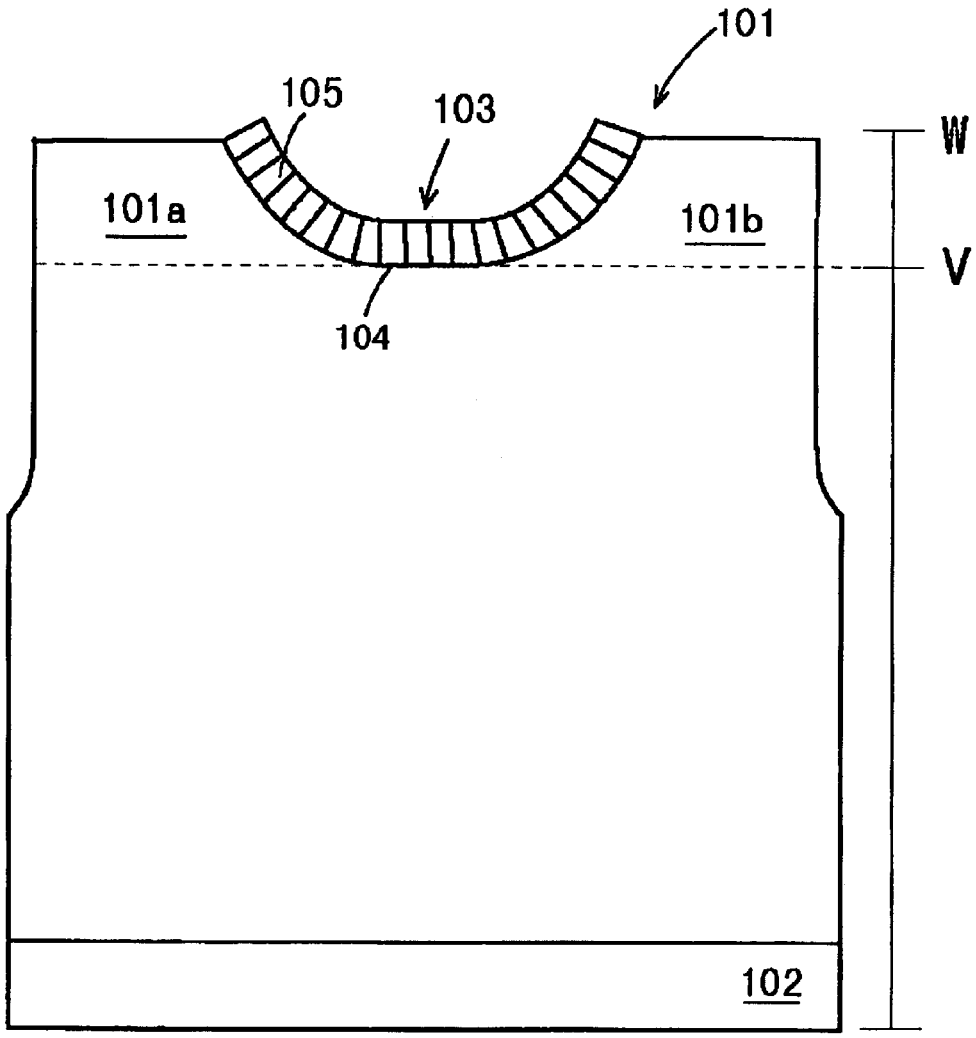
FIG. 7 is a view showing a front part of the sweater formed in a conventional art.
Figure 8:
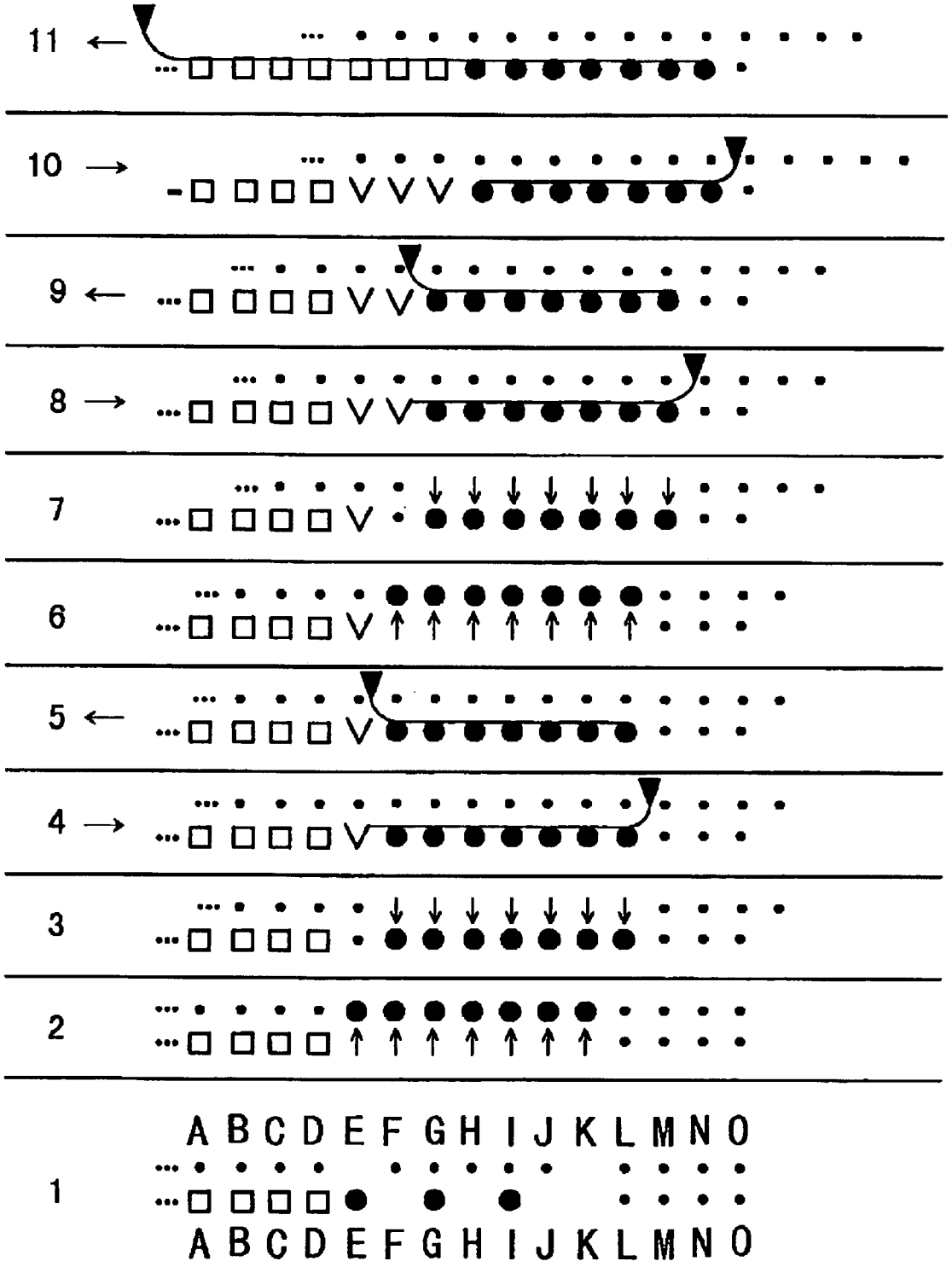
FIG. 8 is a knitting course diagram of the conventional art.

The third embodiment of the present invention is described with reference to FIG. 6. The third embodiment is an embodiment of a method of knitting a fabric having a parachute pattern radiating outward with a uniform radius. FIG. 6-*a* is a front view of a fabric 61 formed in the third embodiment, FIG. 6-*b* is a plan view thereof, and FIG. 6-*c* is a view showing the fabric 61 which is in the state to be knitted on the flat knitting machine. The knitted fabric 61 is knitted in a tubular form from a set up portion 62 to the direction indicated by arrow Z. Specifically, in the condition in which a lateral dimension of the knitted fabric 61 is oriented to a lengthwise dimension of the needle bed, a front knitted fabric part 61*a* and a back knitted fabric part 61*b* are knitted into a tubular knitted fabric in which the front and back knitted fabric parts are continuous with each other at both ends thereof. After the knitting reaches a line J, the flechage knitting is performed by the yarn feeders being reversed in both directions 65, 66 indicated by arrows at ends of the knitting width of the right flechage knitting regions 63*a*, 63*b* and at ends of the knitting width of the left flechage knitting regions 64*a*, 64*b*, respectively, to feed the yarns in a U-shape curve. After the completion of the knitting of both of the right flechage knitting regions 63*a*, 63*b* and the left flechage knitting regions 64*a*, 64*b*, the yarn is circularly fed again to the knitted fabric throughout the whole knitting width from a line K. Also, whenever an appropriate number of courses are knitted, the narrowing wherein the loops of the knitted fabric which are positioned outside of a joining line 67 are shifted toward a center line W—W of the knitted fabric and then the adjacent loops are overlapped with each other is performed. This knitting is repeatedly performed to form the parachute pattern. In the knitted fabric 61 thus formed, an insufficient knitted fabric length is compensated by the flechage knitting before the parachute pattern is formed, so that a diameter of the parachute pattern is kept uniform. Therefore, the parachute pattern is prevented from being strained or loosened and also even when a color pattern is formed in the parachute pattern, the color pattern can be prevented from being transformed. This can produce the knitted fabric having a high commercial value. Although the method of knitting the tubular knitted fabric has been described in the third embodiment, the method of the present invention is practically applicable to the knitting of a flat knitted fabric as well as the knitting of the tubular knitted fabric. Although the right and left flechage knitting regions are divided into two right-and-left-flechage-knitting regions, one of which is formed on one of the front and back needle beds and the other of which is formed on the other of the front and back needle beds, in the embodiments mentioned above, the right flechage knitting region and the left flechage knitting region may be knitted on the front needle bed and the back needle bed, respectively: For example, the right flechage knitting region is knitted on the front needle bed and the left flechage knitting region is knitted on the back needle bed.

Although the two-bed flat knitting machine is used in the embodiments mentioned above, the knitting method of the present invention is also practicable by using a four-bed flat knitting machine comprising a pair of lower needle beds and a pair of upper auxiliary needle beds on which loop transfer needles and transfer jacks are arranged in the same pitch as those arranged on the lower needle beds. Further, the present invention is not limited to the knitting of a knitted fabric having the pattern mentioned above. The present invention is applicable to the knitting of a knitted fabric including flechage knitting region where the flechage knitting that the yarn feeder is caused to reverse in yarn feed direction at some midpoints of knitting width to put the needles in the rest state sequentially from the needle positioned outside of the knitting width is repeatedly performed; and stitch move region where at least a part of loops in the flechage knitting region are transferred between the front and back needle beds to move the loops laterally.

Capabilities of Exploitation in Industry

According to the present invention, the knitted of a knitted fabric, such as a vest or a sweater with a front drop formed at the neckline opening or having a pattern commonly known as the parachute pattern having joining lines along which adjacent loops are overlapped with each other radiating outward from around the neckline opening, wherein at least a part of loops in the flechage knitting region formed in such a manner that yarn is caused to reverse in yarn feed direction at some midpoints of knitting width are transferred between front and back needle beds, for stitch move, can be carried out without causing yarn breakage, elongation of loop and like problems.

What is claimed is:

1. A method of knitting a fabric on a flat knitting machine having a pair of front and back needle beds, at least one of the needle beds being laterally racked, the method comprising:

(a) forming a flechage knitting region using a flechage knitting;

(b) performing a stitch move by transferring loops in the flechage knitting region between the front and back needle beds to laterally move the loops;

(c) moving the front and back needle beds relative to each other after loops in a stitch move region are transferred to an opposite needle bed to laterally move the loops whenever a predetermined number of courses in the flechage knitting region are knitted;

(d) holding loops of wale placed in a rest state on the needle bed opposing the needle bed on which loops of the next course are formed in a s subsequent flechage knitting until the stitch move is completed;

(e) transferring only the loops of wale in which the loops of the next course are formed in the subsequent knitting to their originally retained needle bed prior to forming the loops of the next course; and (f) repeatedly performing the knitting method of steps (a) through (e).

2. A method of knitting a fabric on a flat knitting machine having at least a pair of front and back needle beds, at least one of the needle beds being laterally racked, the method comprising:

(a) knitting right and left bodies facing each other across a neckline opening with different yarn feeders in a flechage knitting, the knitting of the right and left bodies beginning after the neckline opening is formed;

(b) transferring the right and left bodies between front and back needle beds while loops of the right and left bodies are placed in a rest state sequentially from a wale of loops on a shoulder-point side, the front and back needle beds are moved outwardly to provide empty needles between the neckline opening and the right and left bodies;

(c) forming new loops on the empty needles to increase the number of wales around an edge portion of the neckline opening;

(d) forming a collar around the neckline opening;

(e) performing a stitch move while the right and left bodies are knitted in the flechage knitting;

(f) knitting at least one of the right and left bodies in the flechage knitting for a predetermined number of courses;

(g) retaining the knitted body on an opposite needle bed, and moving the front and back needle beds relative to each other in a direction in which the neckline opening is expanded;

(h) transferring only loops of wale that are sequentially knitted in a subsequent flechage knitting of the retained knitted body to the original needle bed; and (i) repeatedly performing the steps (f) to (h) until the knitting of the one body is completed.

3. A method of knitting a fabric having a body and sleeve on a flat knitting machine having at least a pair of front and back needle beds, at least one of the needle beds being laterally racked, the method comprising:

(a) knitting the sleeve on the side of the body;

(b) shifting a portion of the sleeve extending from an underarm to a shoulder toward the body, such that loops of the sleeve and loops of the body overlap at ends thereof on adjacent sides;

(c) forming loops of a next course in double loops thus formed;

(d) repeatedly performing steps (a) to (c) to knit a knitwear having the sleeve and the body joined together;

(e) forming an adequate number of wales of the sleeve and the body positioned around the boundary therebetween in joining regions between the sleeve and the body;

(f) reducing the sleeve and the body while the yarn is fed to the sleeve and the body thereby forming a parachute pattern;

(g) connecting a predetermined number of the wales of the body and the sleeve around the boundary therebetween in at least one of a right flechage knitting region or left flechage knitting region;

(h) retaining the sleeve in the step (g) on the needle bed opposite the needle bed on which the body is retained, and moving the front and back needle beds relative to each other in a direction in which the sleeve moves closer to the body;

(i) transferring the loops of the wale of the sleeve retained on the opposite needle bed in the step (h), wherein loops of a next course are formed in a subsequent knitting to the needle bed on which the body is retained, such that the loops of the sleeve overlap with the loops of the body at ends thereof on adjacent sides to join the sleeve and the body; and (j) repeatedly performing the steps (g) to (i) until the flechage knitting regions formed around the boundary between the sleeve and the body are completed.

4. The method of knitting according to claim 3, wherein the sleeve is a right sleeve.

5. The method of knitting according to claim 3, wherein the sleeve is a left sleeve.

* * * * *